US006414581B1

(12) United States Patent
O'Loughlin et al.

(10) Patent No.: US 6,414,581 B1
(45) Date of Patent: Jul. 2, 2002

(54) AIR CORE TRANSFORMER WITH COAXIAL GRADING SHIELD

(75) Inventors: James P. O'Loughlin, Placitas; Diana L. Loree, Albuquerque; Jane Lehr, Placitas; Gerald J. Rohwein, Albuquerque, all of NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 64 days.

(21) Appl. No.: 09/640,203

(22) Filed: Aug. 16, 2000

(51) Int. Cl.[7] ..... H01F 27/30

(52) U.S. Cl. ..... 336/198; 336/208; 336/182; 336/175

(58) Field of Search ..... 336/198, 208, 336/174, 175, 182

(56) References Cited

U.S. PATENT DOCUMENTS

| | | | | | |
|---|---|---|---|---|---|
| 3,590,329 | A | * | 6/1971 | Krepps, Jr. | |
| 3,665,356 | A | * | 5/1972 | Douglas et al. | 336/73 |
| 5,034,086 | A | * | 7/1991 | Sato | 156/345 |
| 6,018,239 | A | * | 1/2000 | Berkcan et al. | 324/127 |
| 6,326,877 | B1 | * | 12/2001 | Hay et al. | 336/198 |

* cited by examiner

*Primary Examiner*—Anh Mai
(74) *Attorney, Agent, or Firm*—James M. Skorich; Kenneth E. Callahan

(57) ABSTRACT

A slotted coaxial shield for high voltage cylindrical air core transformers is described that controls the electric field stress while permitting the rapid extraction of electric energy stored in the shield to improve the output efficiency.

4 Claims, 7 Drawing Sheets

AIR CORE TRANSFORMER WITH COAXIAL GRADING SHIELD

STATEMENT OF GOVERNMENT INTEREST

The conditions under which this invention was made are such as to entitle the Government of the United States under paragraph 1(*a*) of Executive Order 10096, as represented by the Secretary of the Air Force, to the entire right, title and interest therein, including foreign rights.

BACKGROUND OF THE INVENTION

1. Field of the Invention

The invention is in the field of dual resonant transformers used for charging pulse-forming networks, and in particular relates to a design for the improved efficiency for such transformers.

2. Description of the Prior Art

The dual resonant transformer is important in applications requiring the charging of Pulse Forming Networks (PFN) because it provides a high voltage step-up, has a high energy transfer efficiency, and is very compact and inherently well configured for megavolt level operation. The simplified circuit of a dual resonant transformer applied to a PFN charging circuit is shown in FIG. 1. The operation consists of initially storing energy in the primary capacitor, C1, at a low voltage, typically on the order of 50 kV. The PFN, or other capacitive load to be charged, is connected to the secondary of the transformer. The total secondary equivalent capacitance, C2, consists of the PFN (or other load) capacitance, $C_{PFN}$, plus the stray capacitance, $C_s$. The primary open-circuit inductance of the transformer is L1, and the secondary open-circuit inductance is L2. The double tuned condition is implemented by satisfying the relation, $L1*C1=L2*C2$. The voltage ratio, that is the voltage to which C2 (PFN and stray capacitance) is to be charged, divided by the initial voltage on C1, is determined by the square-root of the inductance ratio, $(L2/L1)^{1/2}$. In addition to both of these conditions the coupling coefficient of the transformer must be 0.600. That is $k=M_{12}/(L1*L2)^{1/2}$, where $M_{12}$, is the mutual inductance between L1 and L2.

When all three of these conditions are fulfilled the initial energy in C1 will be totally transferred to C2 in a time duration of $1.6673*(L1*C1)^{1/2}=1.6673*(L2*C2)^{1/2}$, measured from the closure of the switch connecting C1 to the primary of the transformer. The capacitance C2 is the total effective capacitance on the secondary of the transformer and consists of the useful load capacitance and the transformer "stray" capacitance. The normalized voltage waveforms of V1 and V2 are also shown in FIG. 1. It is important to recognize that a high-energy transfer efficiency does not necessarily mean a high over-all efficiency. In applications where the useful load capacitance is on the order of, or less than, the stray capacitance, the loss of the stray capacitance energy greatly limits the efficiency of the transformer charging system. Such applications include Ultra Wide Band (UWB) generators. In UWB applications the pulse being generated typically has a voltage amplitude on the order of a megavolt and is of nanosecond or sub-nanosecond duration. Consequently the pulse has a very low energy content, typically on the order of a few joules. At megavolt operating voltages the electric field stress must be carefully managed to prevent arc down faults in the insulation. To accomplish this it is necessary to use field shaping conductors to eliminate high stress concentrations related to geometry features with small radii of curvature.

The effect of shielding is illustrated in FIGS. 2*a* and 2*b*, both of which show a cross-section of a cylindrical coil. The ground end of the coil is to the outside and the high voltage end is to the inside. The equipotential field lines have been calculated using a computerized Laplace solver. The intensity of the electric field is indicated by the closeness or bunching of the equipotential lines. It can be seen that with "doughnut" ring shield 11, the bunching is reduced and thus the electric field stress is lower. The introduction of ring shield 11 increases the stray capacitance of the system and also couples to the magnetic field of the transformer. The stray capacitance increases the energy storage.

It is the purpose of the present invention to make productive use of this increased energy storage. The coupling to the magnetic field reduces the transformer inductances and also decreases the coupling coefficient. These magnetic effects can be completely counteracted by carefull design of the field shaping conductors or shields in relation to the magnetic field of the transformer. At a voltage of 1 MV, a capacitance of 1 pF corresponds to an energy of ½ Joule. A typical transformer stray capacitance is on the order of 50 pF or 25 Joules at 1 MV, therefore, the degradation of efficiency is very significant for UWB or other low pulse energy applications.

FIGS. 3*a* and 3*b* show, in more detail, typical "doughnut" ring shields 11. The shields 11 must have a gap 13 to prevent the ring from acting as a shorted turn on the transformer flux. The ring shields 11 must also be connected electrically by lead 15 to the output connection electrode or lead in order to accomplish the field grading function. The very nature of the rings as well as the electrical connections are inductive. Therefore, because of this inductance, the capacitive energy stored in the ring cannot be rapidly removed to the load. A simplified equivalent circuit illustrating this is shown in FIG. 4.

The equivalent circuit in FIG. 4 shows how the capacitive energy stored in the grading rings and the transformer secondary winding must pass through the inductance of the rings and the electrical connections to be delivered to the output. In so doing, this energy is delayed by the inductance and is therefore not available as useful output energy on a fast time scale.

SUMMARY OF THE INVENTION

High voltage cylindrical air core transformers must have shields to control the electric field stress. However, the energy stored in conventional shields cannot be usefully extracted. The present invention provides for this shield by means of a new coaxial type configuration. Slots in the shield permit the normal transformer flux to couple the primary and secondary windings. This coaxial shield provides the required electric field stress control as well as the conventional shield does. In addition, the coaxial shield permits the very rapid extraction of the energy stored in the electric field, which then becomes useful output energy. The energy stored in the coaxial shield is approximately equal to that which would be stored in a conventional shield having a capacitance of typically 50 picoFarads. In applications such as UWB, the total load capacitance is also on the order of 50 picoFarads, leading to a factor of two improvement in efficiency.

BRIEF DESCRIPTION OF THE DRAWINGS

The various features of novelty that characterize the invention are pointed out with particularity in the claims annexed to and forming a part of this disclosure. For a better understanding of the invention, its operating advantages, and specific objects attained by its uses, reference is made to the accompanying drawings and descriptive matter in which a preferred embodiment of the invention is illustrated.

DESCRIPTION OF THE PREFERRED EMBODIMENT

Heretofore the stray energy in the transformer, as explained above, has been ignored. This was largely because previous applications dealt with load energies that were typically very large compared to the stray energy. Therefore, the impact on efficiency was not significant or at least was tolerable. The present invention provides for the beneficial use of the transformer stray energy and is, therefore, very important to applications such as UWB and other low energy per pulse loads.

Figure 1A:
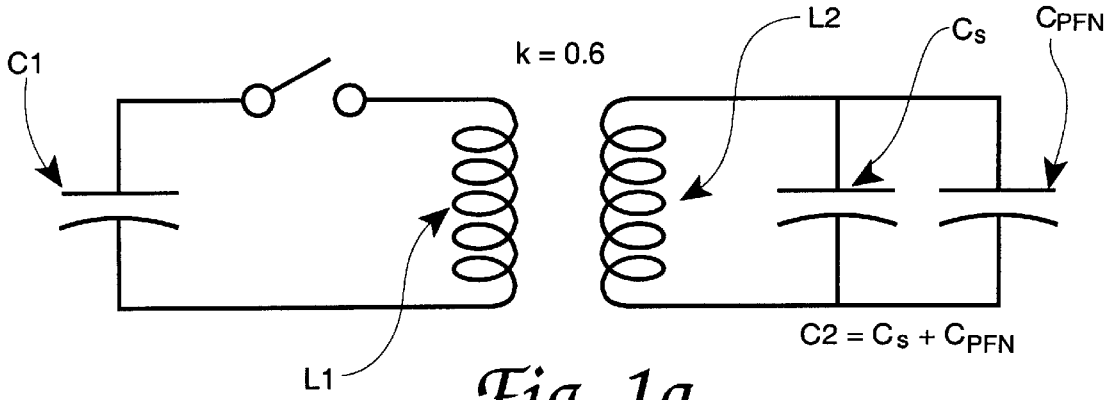
Fig. 1a PRIOR ART
FIG. 1*a* is a schematic diagram of a dual resonant charging circuit.
Figure 1B:
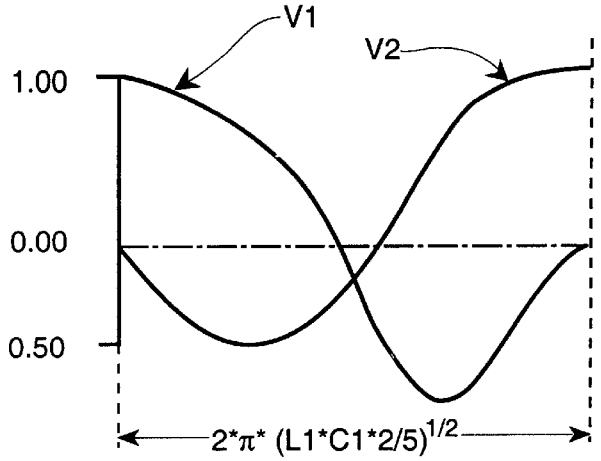
Fig. 1b PRIOR ART
FIG. 1*b* shows the normalized voltage waveforms V1 and V2 for L1 and L2 of FIG. 1*a*.
Figure 2A:
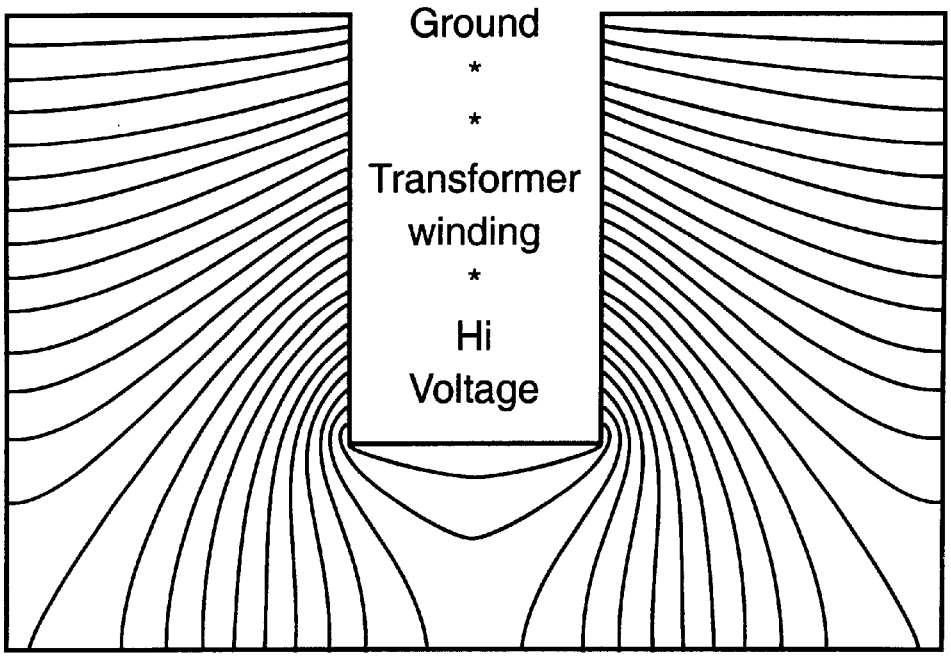
FIG. 2 shows how field-shaping conductors can reduce the electric field intensity.
Figure 2B:
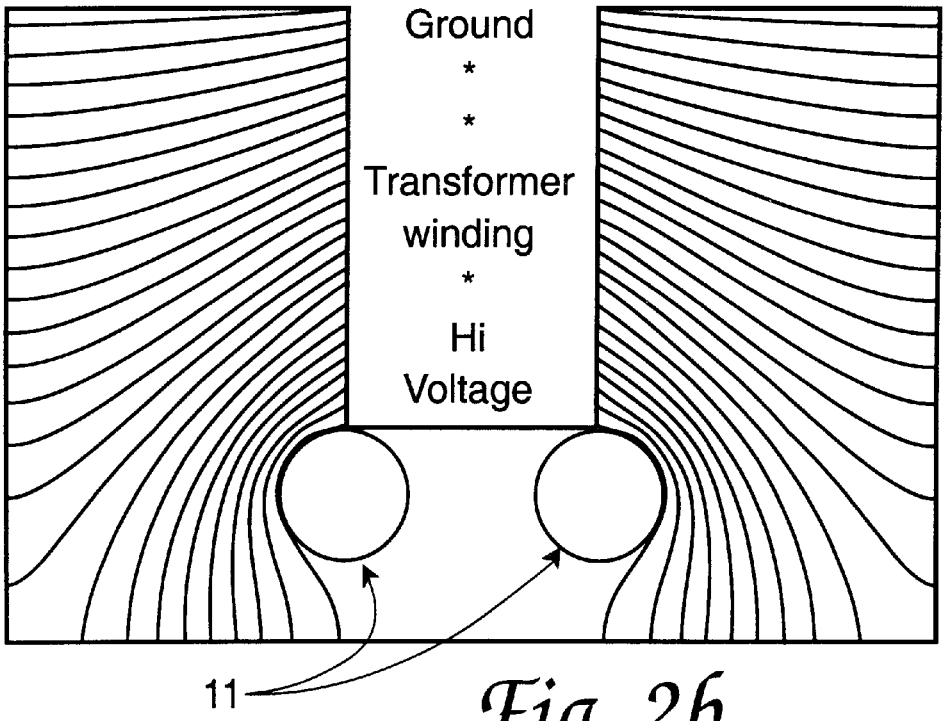
Fig. 2b PRIOR ART
Figure 3A:
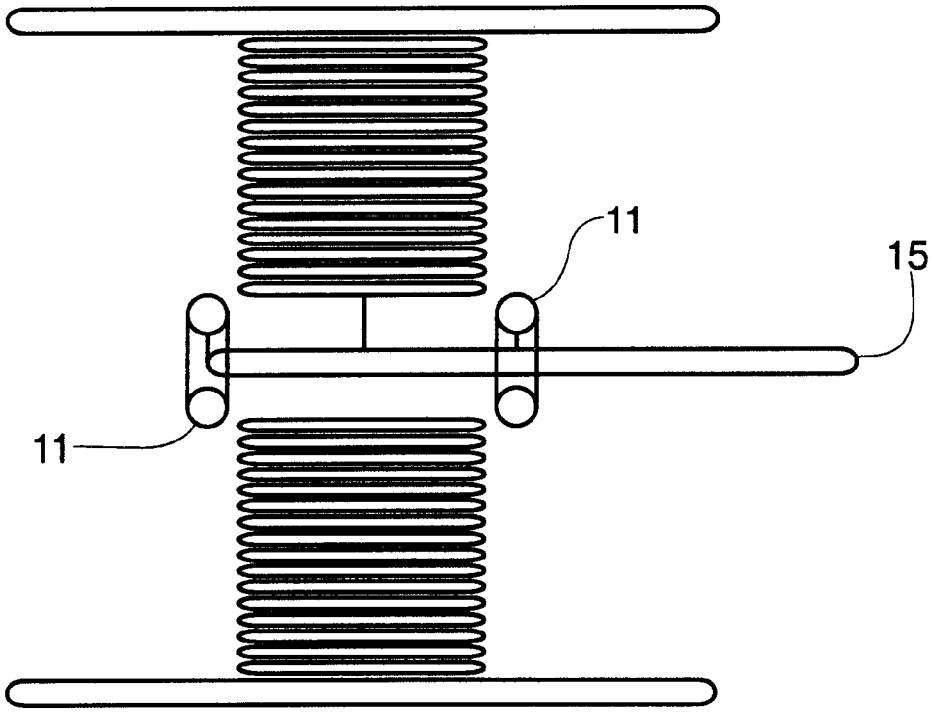
FIG. 3*a* is a cross-section of a transformer showing prior art "doughnut" ring shields.
Figure 3B:
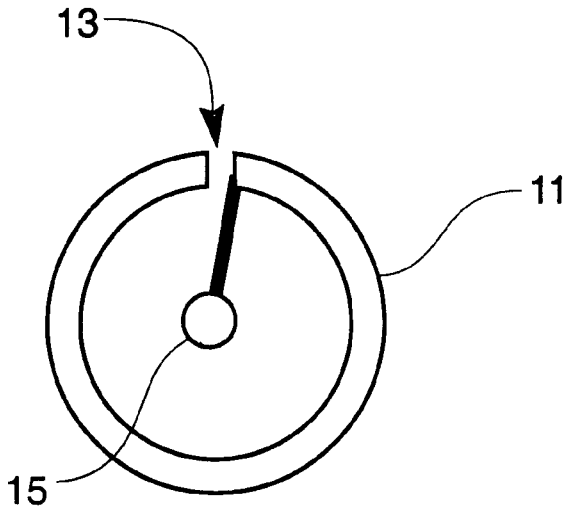
Fig. 3b PRIOR ART
FIG. 3*b* is an enlarged end view of a prior art ring shield showing the electrical connection and the gap.

This invention is based on the construction of the field shaping electrodes or shields formed in a coaxial configuration rather than the toroidal or "doughnut" configuration shown in FIGS. 2*a* and 2*b* and in FIGS. 3*a* and 3*b*. These prior art diagrams show the cross-section of a coil, which is wound with a ribbon conductor. The ground end of the coil is located on the outer radius and the high voltage end is located at the inner radius. The field lines shown in FIGS. 2*a* and 2*b* are the equipotential lines. The closer the equipotential lines are, the greater the field enhancement and the higher the stress on the insulation.

The purpose of the shield is to grade the electric field in such a manner as to limit the maximum intensity to a value that is less than the breakdown value of the insulation. In general the electric field depends on the geometry. The smaller the radius of curvature of a conductor, the higher the electric field will be in the insulation near the surface of that curvature. If the strength of the electric field exceeds the breakdown stress of the insulation, the insulation will fail.

Figure 4:
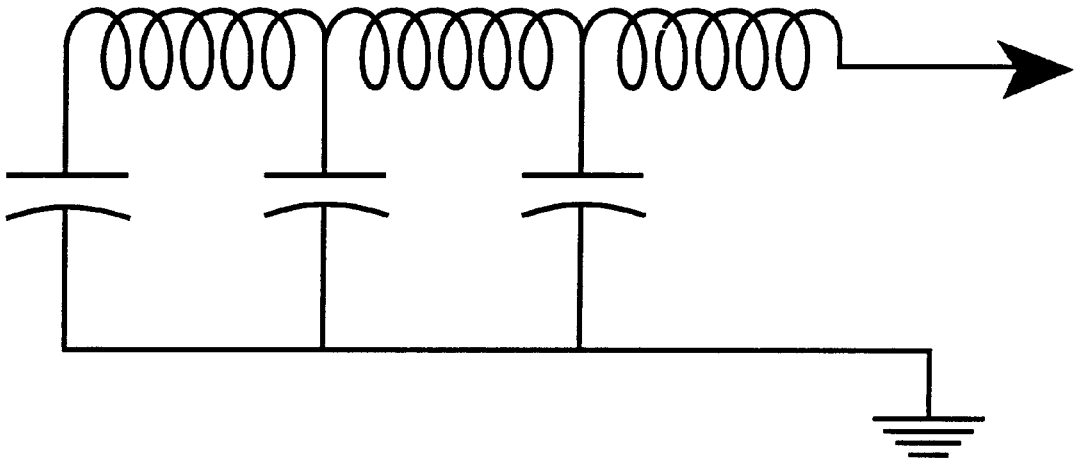
FIG. 4 is an equivalent circuit for the transformer of FIG. 3*a*.

In the case of the "Doughnut" or ring shields 11, the associated capacitive energy cannot be rapidly extracted, as a result of the inductive nature of the rings and electrical connections, as illustrated by the equivalent circuit diagram in FIG. 4.

The present invention utilizes the principle of the coaxial conductor pair, which is modified to accomplish three key functions. The coaxial conductors must, (1) provide for the rapid extraction of the stored electrostatic energy to the load, (2) provide for the grading of the electric field intensity and, (3) not objectionably interfere with the transformer flux.

A coaxial pair of conductors constitutes a coaxial transmission line. The most significant parameters of such a transmission line are the characteristic impedance, the delay time or length, and the capacitance. These parameters are related to the geometry and material as follows. The characteristic impedance in Ohms is:

$$Z_0 = \frac{60}{\sqrt{\varepsilon}} \ln\left(\frac{r2}{r1}\right)$$

Where: $r^2$=outer radius, $r^1$=inner radius, and $\epsilon$=relative dielectric constant between $r^1$ and $r^2$. The delay time in seconds is:

$$\tau = \frac{l\sqrt{\varepsilon}}{c}$$

Where: l=length in meters, and c=speed of light.

$$C = \frac{l\sqrt{\varepsilon}}{cZ_0}$$

The capacitance in Farads is:

The time required to extract or deliver the energy is very fast, approximately $2\tau$, typically on the order of a few nanoseconds.

Figure 5:
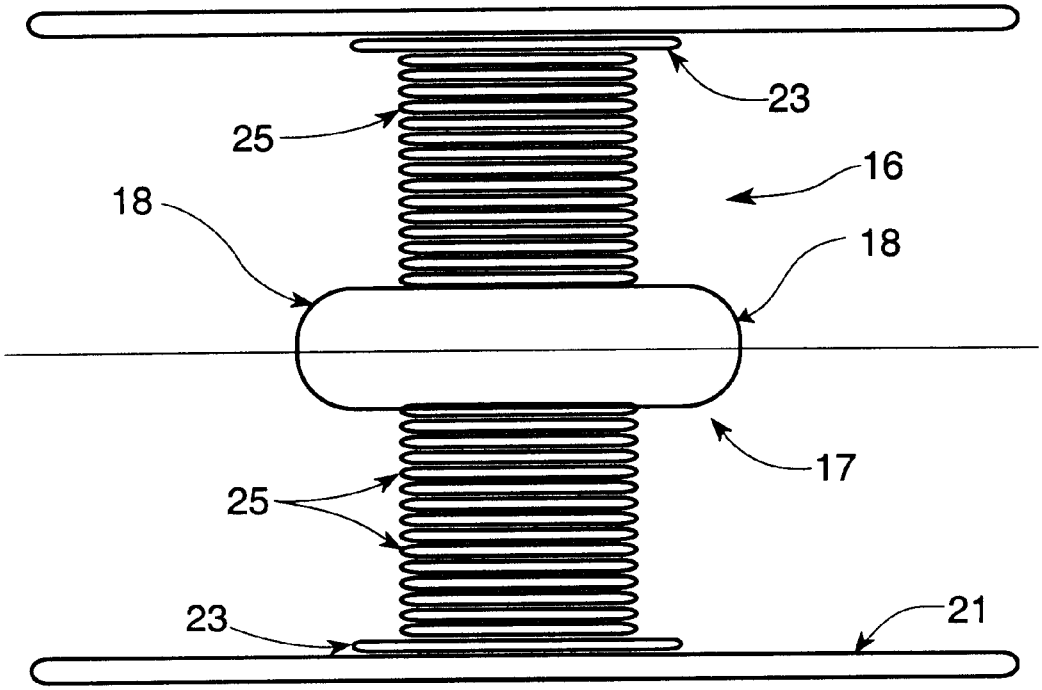
FIG. 5 is a cross-section of a transformer located inside a coaxial structure as proposed in the present invention.

The coaxial shield is used to accomplish the field grading by locating the transformer 16 inside the coaxial assembly and modifying the inner conductor 17 by rounding its ends 18, as shown FIG. 5. The radius of the rounding is similar to the radius used on the rings 11 in FIGS. 3*a* and 3*b* and accomplishes the same purpose for the same reason.

The coaxial assembly must be modified such that it does not significantly interfere with the transformer flux. The basic operation of a transformer depends upon the flux coupling or looping between the primary and secondary windings of the transformer. This coupling is the mechanism by which energy is transferred from the primary to the secondary winding and the means by which a voltage step-up is achieved. The electric field shaping electrode must be a conductor, and a time varying flux, such as in a transformer, cannot penetrate a conductor.

Figure 6A:
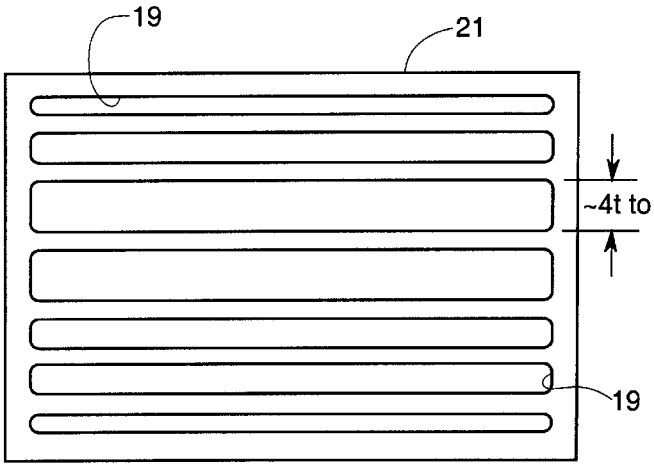
FIG. 6*a* shows the axial slots in the outer coaxial conductor.
Figure 6B:
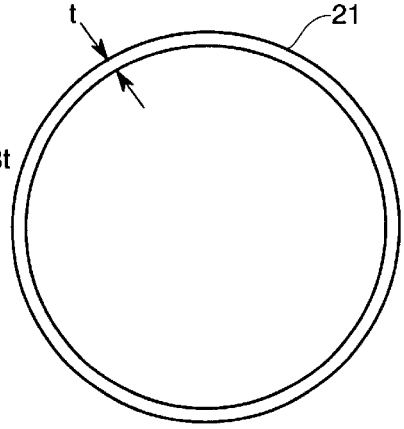
FIG. 6*b* is an end view of the outer coaxial conductor.
Figure 6C:
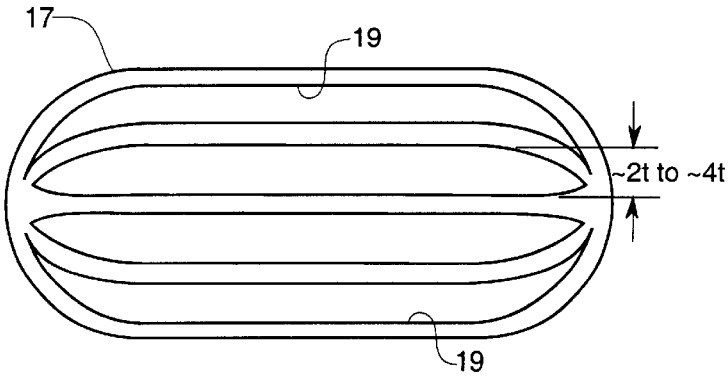
FIG. 6*c* shows the axial slots in the inner coaxial conductor.
Figure 6D:
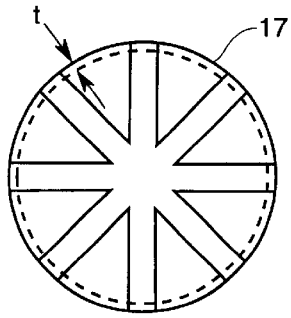
FIG. 6*d* is an end view of the inner coaxial conductor.
Figure 7:
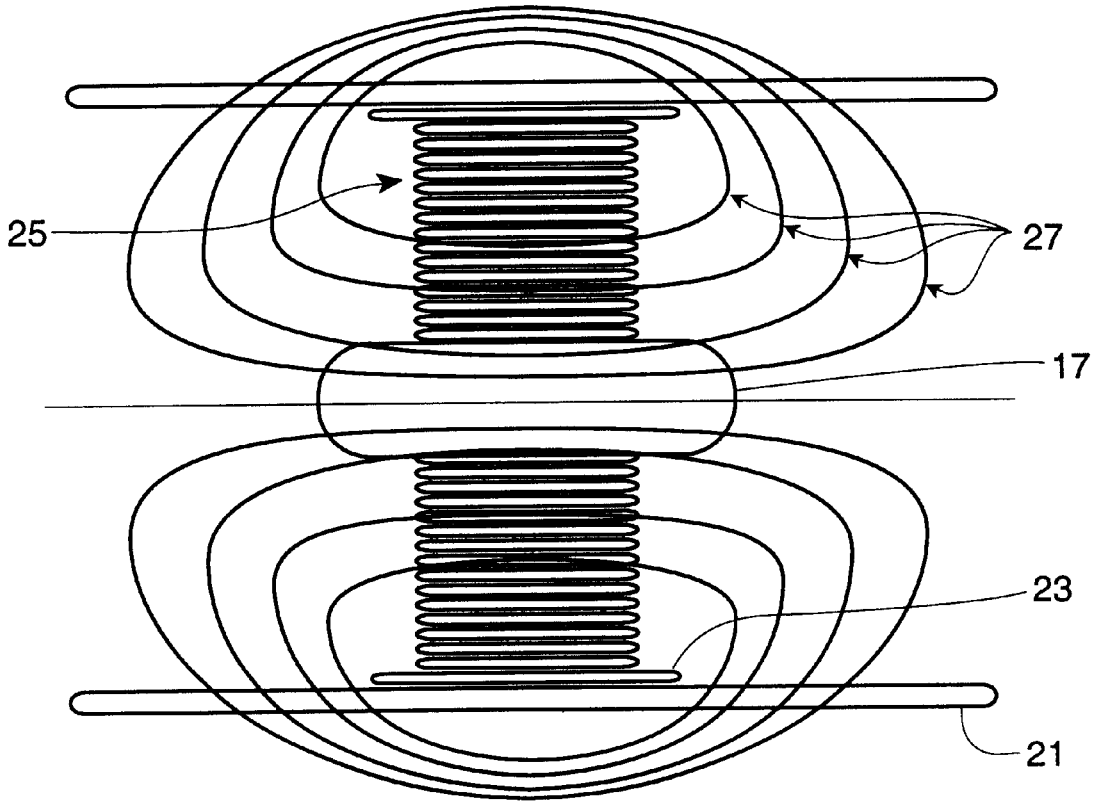
FIG. 7 is a qualitative diagram of the flux pattern with the proposed slotted coaxial shield.

Therefore, axial slots 19 in both the inner coaxial conductor 17 and outer coaxial conductor 21, as shown in FIGS. 6*a* and 6*c*, are introduced to limit the interference of the shield with the flux coupling between primary winding 23 and secondary winding 25. The slots are wide enough let the flux through, couple the windings, and retain the fast energy transmission properties of a coaxial assembly, yet narrow enough to be effective in grading the electric field stress. It has been estimated by calculation and verified by experiments that the optimum slot width in the inner conductor 17 should be on the order of 25% to 50% of the center-to-center slot spacing. The optimum slot width on the outer conductor 21 is larger, on the order of 50% to 75% of the center-to-center slot spacing. The optimum width of the slot 19 should be on the order of about two to four times the thickness of the inner conductor 17 and four to eight times the thickness of the outer conductor 21. These relative dimension ranges are approximate and actual usable and successful designs may vary considerably from these guide values. Although it is not shown in the Figures, one must always radius the edges of the coaxial shields to inhibit and control the electric field enhancement. Typically one would use an edge radius of approximately one half of the material thickness. A qualitative diagram of the flux pattern 27, which links the primary winding 23 and secondary winding 25 through the slots 19, is shown in FIG. 7.

The slotted coaxial shield configuration provides an electric shield with the proper geometry to control the enhanced stress of the electric field and permits the electric energy stored in the shield to be extracted very rapidly as useful output. Alternative modes of implementation of the shield include fabricating it from sheet stock formed into cylinders with slots and rolled or machined edges and fabricating it from machined bars or rods with associated structural parts. In all cases the coaxial nature must be preserved and the slots must be used to provide for the coupled flux. Also all edges must be rounded and smoothed to control and limit the electric field stress due to geometric enhancement.

We claim:

1. A coaxial grading shield for an air core transformer comprising a coaxial assembly comprised of a cylindrical inner and a cylindrical outer coaxial conductor, with an air core transformer located inside said cylindrical outer coaxial conductor, said inner coaxial conductor being cylindrical in shape with rounded, closed ends, and having axial slots, and said cylindrical outer coaxial conductor having axial slots.

2. The coaxial grading shield of claim 1, wherein the width of said inner coaxial slots are approximately 25% to 50% of the center to center slot spacing and the width of said outer coaxial slots are approximately 50% to 75% of the center to center slot spacing.

3. The coaxial grading shield of claim 1, wherein the slot width of said inner coaxial conductor is approximately two to four times the conductor material thickness.

4. The coaxial grading shield of claim 1, wherein the slot width of said outer coaxial conductor is approximately four to eight times the conductor material thickness.

* * * * *